US005231382A

United States Patent [19]

Tanaka

[11] Patent Number: 5,231,382

[45] Date of Patent: * Jul. 27, 1993

[54] PLASMA DISPLAY APPARATUS

[75] Inventor: Akio Tanaka, Tokyo, Japan

[73] Assignee: NEC Corporation, Tokyo, Japan

[ * ] Notice: The portion of the term of this patent subsequent to Aug. 22, 2006 has been disclaimed.

[21] Appl. No.: 662,006

[22] Filed: Feb. 27, 1991

[30] Foreign Application Priority Data

Feb. 27, 1990 [JP] Japan ..... 2-46333

[51] Int. Cl.[5] ..... G09G 3/22

[52] U.S. Cl. ..... 340/771; 340/805; 315/169.4

[58] Field of Search ..... 340/771, 781, 767, 776, 340/784, 767, 805; 315/169.4

[56] References Cited

U.S. PATENT DOCUMENTS 4,097,780 6/1978 Ngo ..... 340/771
4,461,978 7/1984 Mikoshiba et al. ..... 340/781
4,859,910 8/1989 Iwakawa et al. ..... 340/771
5,003,228 3/1991 Hada et al. ..... 340/771

*Primary Examiner*—Ulysses Weldon
*Assistant Examiner*—Amzre Mengistu

[57] ABSTRACT

The invention provides voltage potential differences for selectively discharging cells in a plasma display device, with greater brightness and reduced power consumption. The driving pulses applied to either selected cells or non-selected cells during one scanning cycle includes a high frequency hold mode period after a low frequency address mode period. During the hold mode period, a duty factor of its pulse train is selected to be smaller than that of the address mode period. Particularly, the pulse width of the pulse train in the hold mode period is shorter than an interval of pulses thereof. In other words, the duty factor of the hold mode period is selected to be less than ½ to decrease the voltage causing an erroneous discharge. In another embodiment, to improve brightness, the duration of hold mode is, extended to cover one more scanning cycle.

4 Claims, 4 Drawing Sheets

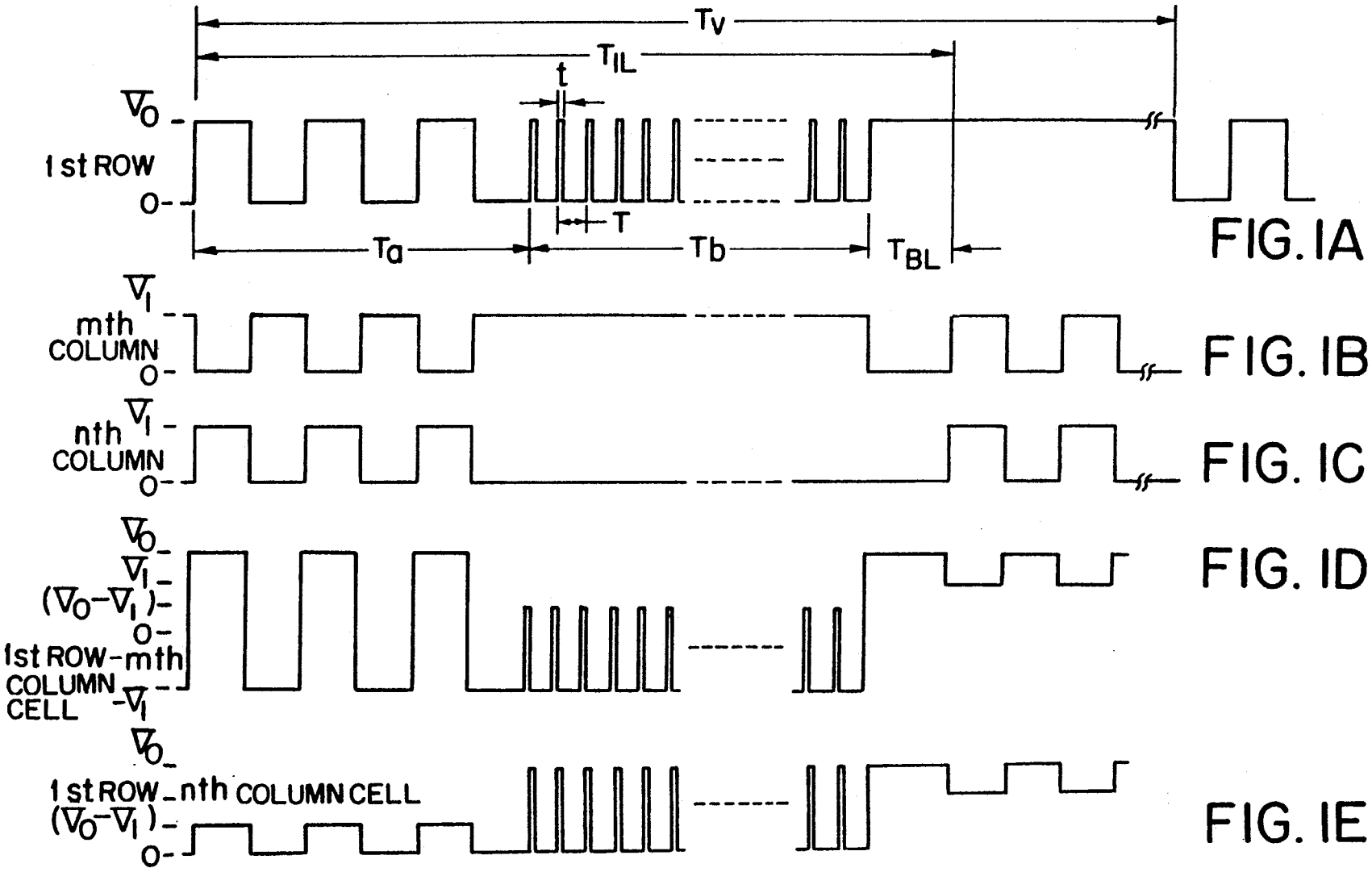
FIG. IA
FIG. IB
FIG. IC
FIG. ID
FIG. IE
Tv
TIL
t
T
Tb
Ta
TBL
V0
1 st ROW
0
V1
mth COLUMN
nth COLUMN
(V0-V1)
1st ROW-mth COLUMN CELL
1st ROW-nth COLUMN CELL Tv
Th
Tb
Ta
TBL
T
Vo
1st ROW
2nd ROW
3rd ROW
0

1st ROW
$V_0$
0
$T_h$
$T_h$
$T_{BL}$
$T_a$
$T_b$

2nd ROW
$V_0$
0
$T_a$
$T_b$ mth COLUMN
$V_1$
0 nth COLUMN
$V_1$
0

1st ROW
mth COLUMN
$V_0$
0
$V_1$

2nd ROW
nth COLUMN
$V_0$
0
t
100nSEC
T400nSEC

PLASMA DISPLAY APPARATUS

BACKGROUND OF THE INVENTION

This invention relates to a plasma display apparatus and more particularly to a drive of AC refresh-type plasma display panel.

A typical example of a conventional AC refresh-type plasma display panel (PDP) to be used in the present invention includes two glass plates having electrode groups which are coated with a dielectric layer. The two glass plates are arranged in a manner which makes electrodes of respective glass plates opposed to each other. Electrodes on each glass plate intersect each other perpendicularly to form a matrix display type. The glass plates are sealed air-tightly with glass frits. Neon gas is filled in the sealed space so as to exist between the glass plates.

When the driving circuit applies a pulsed voltage to electrodes on only one glass plate while maintaining the electrodes on the other glass plate at potential zero, discharge occurs between opposed electrodes to display an image. The voltage discharged at the cell which is the most easy to discharge within the PDP is defined as the minimum unilateral discharge voltage (VDmin). The voltage discharged at the cell which is the most unlikely to discharge within the PDP is defined as the maximum unilateral discharge voltage (VDmax). If electrodes on one glass plate of the PDP have a first pulse train applied thereto with a high voltage (V0) which is higher than VDmin but lower than VDmax while the electrodes on the other glass plate have a second pulse train applied thereto with a low voltage (V1) which has a phase same as or opposite to the first pulse train, the discharge does not occur when the relation holds; $VDmin > |V0| - |V1|$ and discharge occurs when the relation holds; $VDmax < |V0| + |V1|$.

U.S. Pat. No. 4,859,910 issued on Aug. 22, 1989 discloses a new driving method for plasma display panels which results in a high level of brightness, small power consumption and a larger operating range. According to this prior art, the potential difference applied to either selected cells or non-selected cells during one scanning cycle includes a period of an address mode and a period of a hold mode. In the address mode period, a potential difference larger than VDmax is applied to discharge the selected cells while a potential difference smaller than VDmin is applied to the non-selected cells so as not to discharge them. In the hold mode period, on the other hand, the potential difference applied to both of the selected cells and non-selected cells is reduced, but the potential difference has the same amplitude such that the selected cells can continue in the discharge state while the non-selected cells require enough time to start discharge. More particularly, the address mode can be obtained by applying a pulse train of low voltage to a data electrode with the pulse train of high voltage applied to a scanning electrode. The hold mode can be obtained by applying a DC voltage to the data electrode while a high frequency voltage is applied to the scanning electrode. Further the brightness can be increased with a smaller power consumption by increasing the frequency of the hold mode period larger than that of the address mode period. The frequency during the address mode is selected to be low such as 400 KHz to 600 KHz so as to ensure the discharge thereof. In the hold mode, its frequency is selected between 1.5 MHz to 3 MHz.

In this prior art driving circuit, however, both of pulse train in the address mode and the hold mode has a duty factor of ½. The duty factor is defined as a ratio of a pulse width t to a pulse period T (t/T). When a display panel has a large number of pixels with high density, erronious discharge tends to occur. A discharge cell creates exciting particles such as electrons and positively charged particles. Since the mobility of electrons is several hundred times larger than that of the charged particles, the electrons diffuse at first toward an adjacent cell when a positive pulse is applied to the next scanning electrode associated with the adjacent cell along the direction of the scanning electrode. After that, the positively charged particles diffuse toward the adjacent cell along the same direction so as to compensate an electrical nutrality thereat. When these exciting particles reach to the adjacent cell, the cell becomes easy to discharge. At this moment, if the positive pulse is still applied to the scanning electrode associated with the adjacent cell, erronious discharge occurs.

It is possible to prevent such erronious discharge by increasing a frequency of the pulse train of the hold mode further so as to decrease its pulse width. However, such a high frequency operation cause a problem such as low luminescence efficiency due to the fact that a next pulse causes a new discharge before a pair of previous discharges due to a previous pulse have been accomplished.

SUMMARY OF THE INVENTION

It is, therefore, an object of this invention to provide a plasma display apparatus which display an image with a larger operating range.

It is another object of this invention to provide a driving method of plasma display panels for obtaining an improved brightness with a larger operating range.

According to this invention, the driving pulses applied to either selected cells or non-selected cells during one scanning cycle includes a high-frequency hold mode period after a low-frequency address mode period. In the hold mode period, a duty factor of its pulse train is selected to be smaller than that of the address mode pulse train to improve the operating range. In particular, the duty factor of the hold mode period is smaller than 0.5. In other words, the pulse width of the hold mode is selected to be less than an interval of the pulses thereof. In another embodiment, a hold mode period is elongated so as to improve brightness.

BRIEF DESCRIPTION OF THE DRAWINGS

FIGS. 1A to 1E are waveform diagrams showing a relationship between the voltages applied to a scanning or row electrode and data or column electrodes, according to a first preferred embodiment of this invention.

DESCRIPTION OF PREFERRED EMBODIMENTS

Figures 2A, 2B, 2C, 2D, 2E:
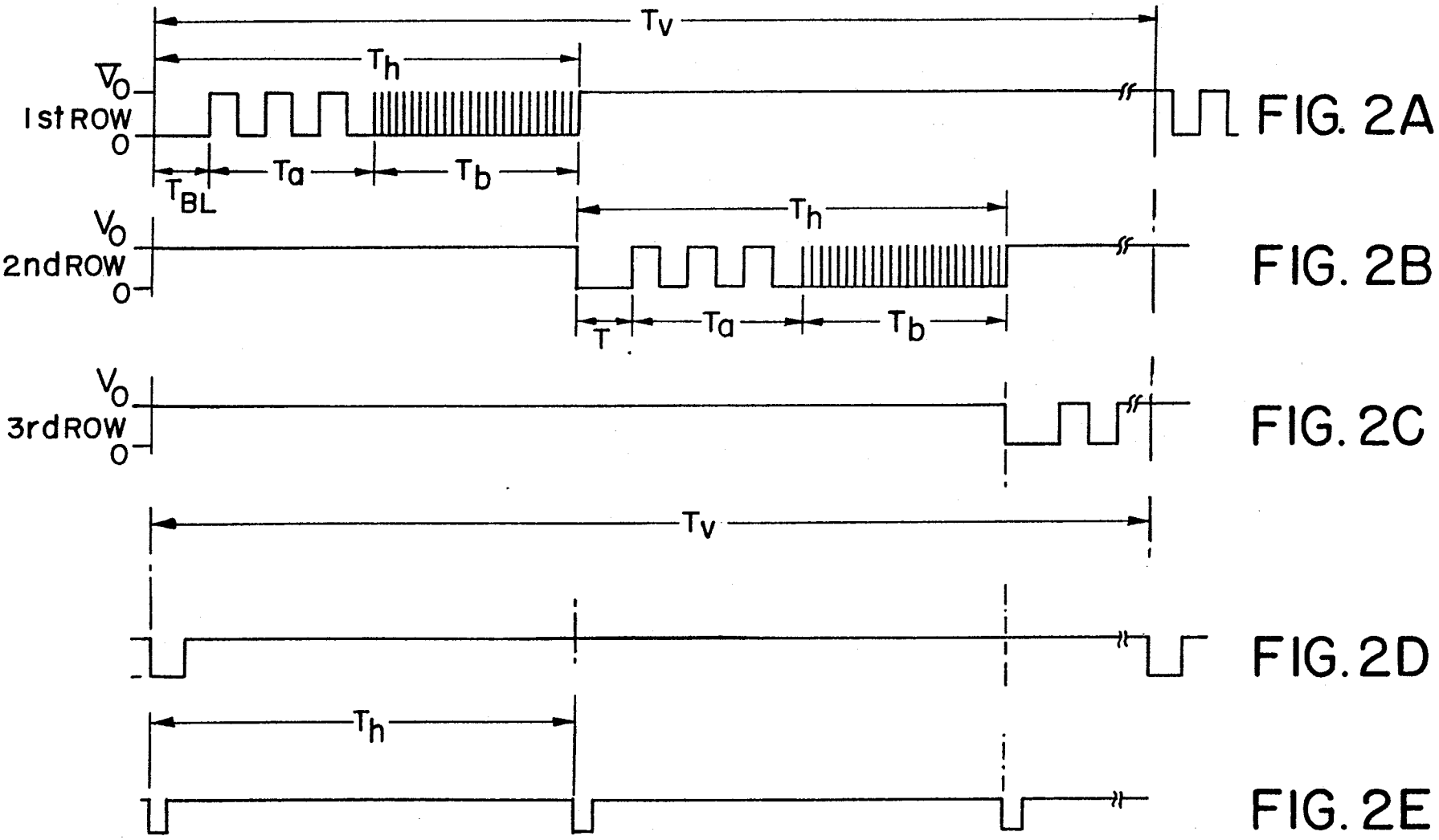
FIGS. 2A to 2E are waveform diagrams showing a pulse train applied at scanning electrodes in a time-division mode.

Referring to FIG. 1, while first and second pulse trains of peak voltage $V_0$ are sequentially applied to the first scanning or row electrode for one scanning period Th, as shown in FIG. 1A, a third, pulse train of peak voltage $V_1$ is applied to the mth data or column electrode for an address mode period Ta which is the same period of the first pulse train as shown in FIG. 1B. Following the pulse train for the period Ta, a direct current voltage is applied to the mth column electrode for a hold mode period Tb which is the same period of the second pulse train as shown in FIG. 1B. The period represented by the letter $T_{BL}$ in FIG. 1 is a blanking period. Thus the sum of the periods, $Ta+Tb+T_{BL}$, indicates the one scanning period Th.

As is shown in FIG. 1B, the third pulse train has a phase which is opposite to the phase of the first pulse train so as to produce a first pulsing potential difference shown in FIG. 1D. This first potential difference is larger than the firing voltage of the selected cell which is formed at the intersection of the first row electrode and the mth column electrode. The fourth pulse train has a phase which is identical with the phase of the first pulse train, as shown in FIG. 1C, so as to produce a second pulsing potential difference shown in FIG. 1E. This second potential difference is smaller than a holding voltage of a selected cell which is formed at the intersection of the first row electrode and the mth column electrode. When the nth column electrode is associated with a non-selected cell which is not to be discharged, the fourth pulse train of peak voltage $V_1$ is applied to the nth column electrode for the address mode period Ta. During the hold mode period Tb, the nth column electrode also has a direct current voltage applied thereto. FIG. 1E shows the potential difference applied to a non-selected cell formed at the intersection of the first row electrode with the nth column electrode.

The potential difference $V_0$, which is applied to the selected cells and non-selected cells during the hold mode period Tb in the one scanning period Th, are completely identical to each other, as shown in FIGS. 1D and 1E.

At the address mode, if the relations set forth below hold, the selected cells which are to glow are discharged and the non-selected cells which are not to glow are not discharged;

$$VDmax < |V1| + |V0| \quad (1)$$

$$VDmin > |V0| - |V1| \quad (2)$$

In the hold mode, the potential difference $V_0$ is applied irrespective of whether the cells are to glow or not to glow. The cells maintain the state which is created at the address mode which preceded the hold mode.

More particularly, as the selected cell is discharged at the period Ta, the selected cell is filled with charged particles generated by the discharge; thus, the following discharge is easily actuated even in the hold mode where the potential difference which is applied is lower than the potential difference which is applied in the address mode.

The foregoing operation is similar to the operation disclosed in the aforementioned U.S. Pat. No. 4,859,910 except for a duty factor at the hold mode period. In the present invention, the duty factor (t/T) of a pulse train during the hold mode is selected to be less than ½. A typical example of a pulse width t at the hold mode period is selected to be about 100 nsec and a pulse period T is selected to be about 400 nsec. Thus the duty factor of the hold mode period is about ¼ under the high frequency of about 2.5 MHz. The applied voltage $V_0$ shown in FIG. 1A is set at 180 V and the applied voltage $V_1$ shown in FIG. 1B and FIG. 1C is set at 30 V. Since the pulse width t is short, the diffusion of the electrons and the charged particles created at the discharge cell can be suppressed. In addition, since the applied pulse turns to ground within a discharge delay time, initial discharge at non-selected cell is also suppressed. From the foregoing reason, erroneous discharge at adjacent cells can be prevented.

For example, in the case of driving a PDP having a fine cell pitch of about 0.34 mm by the prior art method which has a hold mode period with the pulse width of about 200 nsec and the duty factor of about ½, operating range is about 5 V. In contrast, according to the present embodiment, the operating range becomes about 20 V. When the pulse width t becomes too short such as less than 70 nsec, the brightness decreases by more than 20% due to decreasing lumescent efficiency. If the pulse width t is set with more than 160 nsec, the operating range becomes less than 5 V. For these reason, the pulse width t is preferably selected to be 70 nsec to 160 nsec. In other words, its duty factor is selected to be 0.175 to 0.4. More preferably, the pulse width t at the hold mode period is selected to be 100±20 nsec to achieve the operating range of 15 to 20 V. According to the present invention, since the pulse interval (T-t) is large compaired with the pulse width, luminescent efficiency scarcely decrease. By decreasing the pulse width t compaired with the pulse interval (T-t), operating range can be increased, thus the hold mode duration can be increased to improve the brightness. When the duration of the address mode is set at 10 μsec, the duration of the hold mode can be set at about 30 μsec without causing erroneous discharge for a PDP having display cells of 640×480 dots, and thereby improving the brightness by 50% compaired with the prior art method. In addition, the power consumption for driving the data electrodes can be decreased by 50% compaired with the prior art method. The driving frequency for the address mode is preferably selected 1.5 MHz to 3 MHz. A duty factor of the address mode period is preferably selected to be ½ as well as the prior art and its driving frequency is selected to be 400 KHz to 600 KHz.

Needless to say, in order to drive a conventional plasma display panel, the scanning electrode group is selected for the period Th with the horizontal synchronizing signals shown in FIG. 2E. The first electrodes have a pulse train applied thereto with the peak value of $V_0$ shown in FIG. 2A. After a certain period (blanking period), the second scanning electrode is selected. The pulse voltage having the peak value of $V_0$ is applied to the second scanning electrode only for the period Th as shown in to FIG. 2B. The third scanning electrode has a pulsed voltage applied thereto after a pulsed voltage is applied to the second scanning electrode. This operation is repeated sequentially until the time when vertical synchronizing signal arrives or for the period $T_v$. The circuit then returns to the state which allows a selection of the first scanning electrode when the vertical synchronizing signal arrives. Each of the scanning electrodes is sequentially scanned with horizontal synchronizing signals. The circuit is returned to the initial state with a vertical synchronizing signal which is inputted after all the scanning electrodes are scanned. The vertical synchronizing signal is coincidental to the refresh frequency in display and generally is determined as being 55 cycles or higher.

A description will now be given of an example which can still increase the brightness.

FIG. 3 shows arrangement of pulse trains of the second embodiment.

Figures 3A, 3B, 3C, 3D, 3E, 3F:
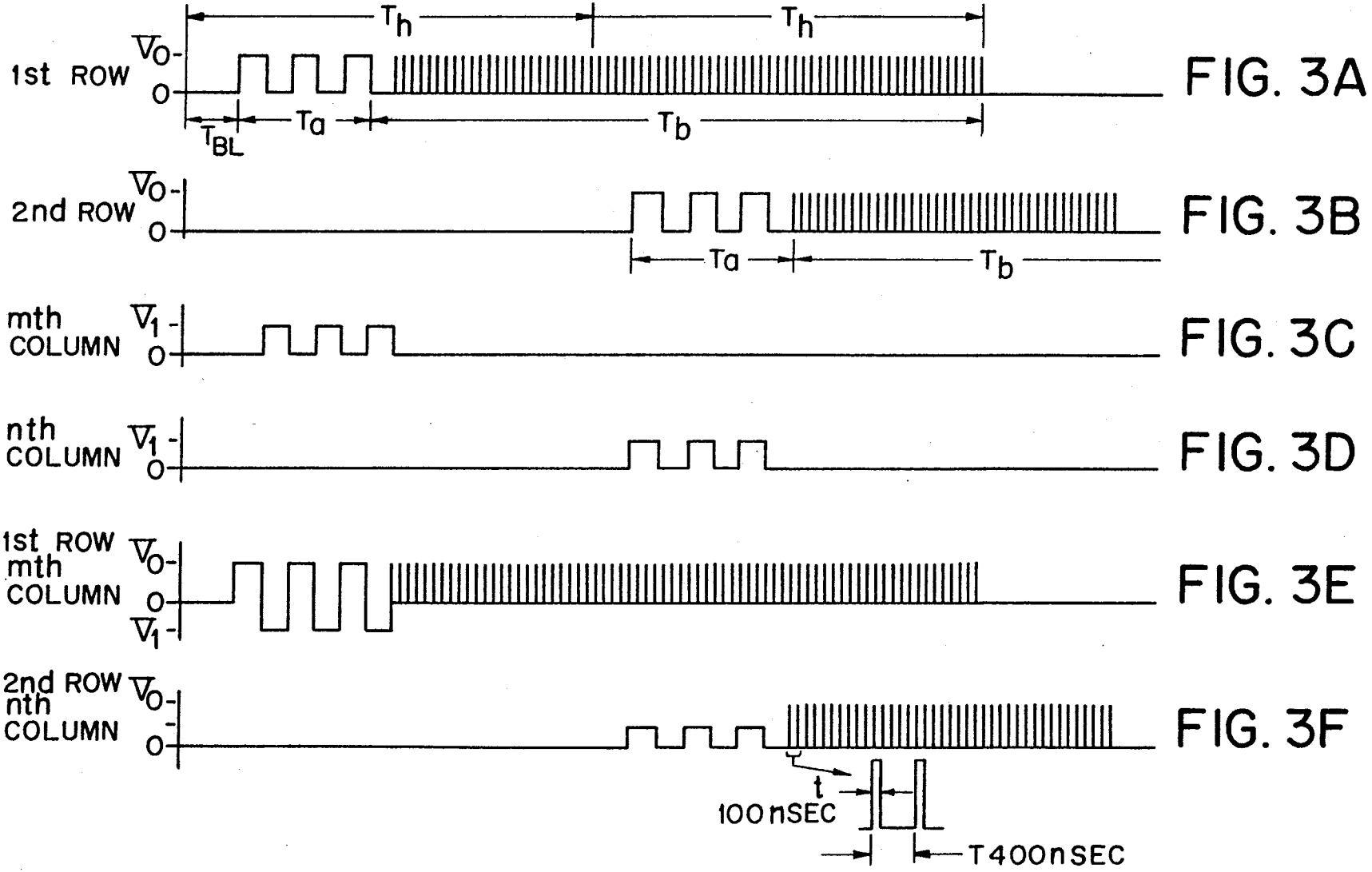
FIGS. 3A to 3F are waveform diagrams showing a relationship between the voltage applied to a scanning electrode and data electrodes, according to a second preferred embodiment of this invention.

FIG. 3A and FIG. 3B show pulse trains of peak voltage $V_0$ applied on the scanning electrodes at the first row and the second row, respectively, in a plasma display panel.

FIG. 3C shows a pulse train of peak voltage $V_1$ applied on the data electrodes of the mth column. FIG. 3D shows the pulse train of peak voltage $V_1$ applied on the data electrodes of the nth column.

FIG. 3E shows the pulsed potential difference applied on the selected (the first row, the mth column) cells defined at the intersections of the first row electrode and the mth electrode. FIG. 3F show the pulsed potential difference applied on the non-selected (second row, the nth column) cells formed at the intersections of the second row electrode and the nth column electrode.

A pulse width t at the hold mode period is selected to be 100 nsec and a pulse period T is selected to be about 400 nsec as well as the first embodiment. In the second embodiment, the duration of the hold mode is succeeded to the most one scanning period $T_h$ such that a second address mode period shown in FIG. 3B is applied to the second scanning electrode while the first hold mode pulse train is still applied to the first scanning electrode. When the duration of the address mode in the second and first embodiments are selected to be equal to each other such as 10 μsec, the total duration of the hold mode in the second embodiment can be set at about 70 μsec, thus the brightness is greatly improved compaired with the first embodiment where the duration of the hold mode is set at about 30 μsec.

Figure 4:
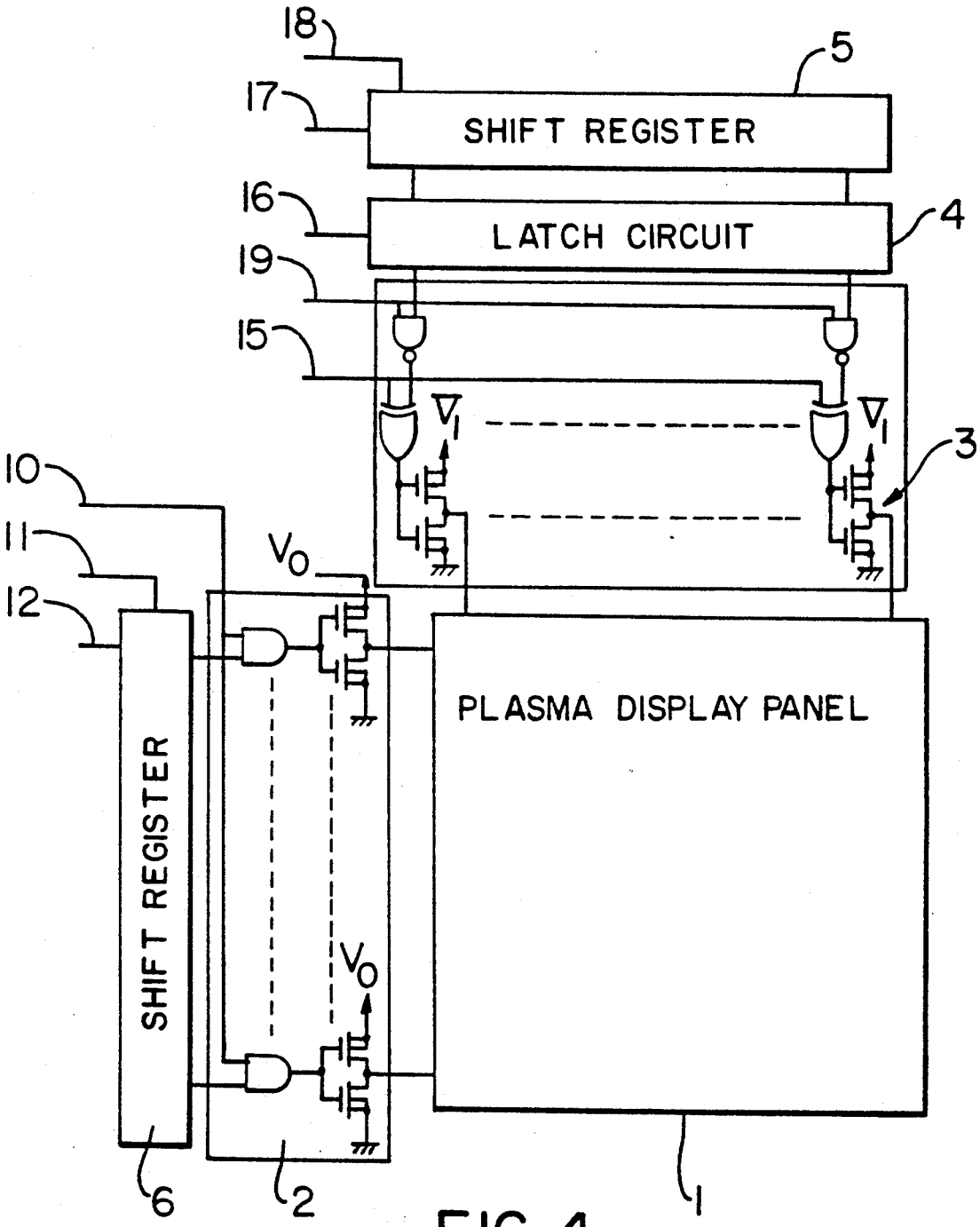
FIG. 4 PRIOR ART
FIG. 4 is a block diagram of a prior art driving circuit for a plasma display panel employed in the apparatus according to the first preferred embodiment of this invention.

FIG. 4 is a block diagram showing a plasma display system according to the present invention. The plasma display system comprises a matrix display type of plasma display panel 1, a driving circuit for the row electrode group 2, a driving circuit for the column electrode group 3, a latch circuit 4 for storing data, a shift register 5 for storing data temporarily, and a shift register 6 for sequentially shifting row electrodes.

The pulse train of peak voltage $V_0$ which is to be applied at row electrodes is generated by a complimentary inverter circuit at the last stage of the driving circuit 2 and has the peak value of $V_0$. The input signals of this circuit 2 are the output from the shift register 6 and the high frequency pulse signal 10 which is inputted from the outside and which are mixed at an AND gate. The output signal of the AND gate is amplified upto the value of high voltage source $V_0$, by the inverter circuit. Thus, the high frequency pulse signal which is inputted from outside and the output from the driving circuit 2, at the last stage, have the same frequency of opposite phases. The shift register 6 receives scanning data signal 11 and scanning clock signal 12 as input. The scanning data signal 11 is sequentially transferred by the scanning clock signal 12 to the AND gate in the driving circuit 2.

The column electrodes driving circuit 3 comprises a complementary inverter circuit which receives the output from an exclusive OR circuit as an input which is to be inverted at the driving circuit. The data inputted at the shift register 5 via the dot data input 17 and the data shift clock signal 18 are transmitted to the latch circuit 4 by a latch pulse signal 16. Each latch output is inputted to an NAND circuit in the driving circuit 3 and is mixed with a blanking signal 19 on the data side that is inputted from outside. This blanking signal is normally at a high level but when this signal is switched to a low level, the output of the NAND circuit can be fixed to the high level in the same way as when the data does not exist, irrespective of the existence of the output of the latch 4. The output of this NAND circuit is further inputted at the exclusive OR circuit in the driving circuit 3 to be mixed with the high frequency pulse signal 15 which is inputted from outside. If there is not output from the latch circuit 4, the output from the exclusive OR circuit has a phase which is opposite to the phase of the high frequency pulse signal 15 which is inputted from outside. The high frequency pulse 15 is then amplified up to the value of voltage source $V_1$, by the inverter circuit. Thus, the pulse train obtained from the column electrodes driving circuit 3 has a phase which is the same as the phase of the high frequency pulse signal 15. Conversely, if there is an output from the latch circuit 4, the output from the exclusive OR circuit has a phase which is identical to the phase of the high frequency pulse signal 15, inputted from outside. The pulse train in the output circuit has the phase opposite thereto.

The DC voltage needed for a hold mode can be obtained by converting the high frequency pulse signal 15 to a DC signal. The conversion in frequency and duty factor which is necessary for the hold mode can be conducted by switching the frequency and duty factor of the high frequency pulse signal 10 that is inputted from outside.

According to the present invention, as is described hereinbefore, since the pulse width at the hold mode of a pulse train applied to the scanning electrodes is shorter than a period between adjacent pulses, the diffusion of the exciting particles created at the discharging cell is suppressed and a new discharge or erroneous discharge at non-selected cell is also suppressed due to a phenomenon of discharge jitter. For these reasons, erroneous discharge can be avoided and an operating range thereof is enlarged compaired with a conventional driving method. Moreover, since there is no need to increase a pulse frequency at the hold mode, a high luminescent efficiency similar to the prior art can be kept.

What is claimed is:

1. A plasma display apparatus comprising a first electrode group and a second electrode group disposed in an opposed relation relative to each other, the space intermediary of the opposed electrode groups being filled with a discharge gas to form cells therebetween, the plasma display comprising:

first means for applying a first pulse train of first voltage to said first electrode group for a first period at a predetermined interval in a time division mode;

second means for applying a second pulse train of said first voltage to said first electrode group for a second period following successively said first pulse train, a frequency of said second pulse train being higher than that of said first pulse train, and a duty factor of said second pulse train being of a value smaller than that of said first pulse train, where the duty factor is a ratio of a pulse width to a pulse period;

third means for applying a third pulse train of second voltage to at least one selected electrode in said second electrode group for said first period, said third pulse train being applied in synchronism and in combination with said first pulse train so as to produce a first pulsing potential difference between the electrodes associated with a selected cell, a phase of said third pulse train being opposite to a phase of said first pulse train such that said first pulsing potential difference is larger than a firing voltage of said cell to provide an address mode operation;

fourth means for applying to non-selected electrodes in said second electrode group and during said first period a fourth pulse train of third voltage pulses in synchronism with said first pulse train so as to produce a second pulsing potential difference between the electrodes associated with non-selected cells in combination with said first pulse train, a phase of said fourth pulse train being identical to the phase of said first pulse train such that said second pulsing potential difference is less than the firing voltage of said cell;

fifth means for applying a first direct-current voltage component in combination with said second pulse train to said at least one selected electrode in said second electrode group during said second period so as to produce a third pulsing potential difference between the electrodes associated with said selected cell, said third pulsing potential difference being smaller than the firing voltage of said cell, but also being large enough to continue the discharge of said selected cell due to a previously discharging state of said selected cell to provide a hold mode operation; and sixth means for applying a second direct-current voltage component in combination with said second pulse train to said non-selected electrodes in said second electrode group for said second period so as to produce a fourth pulsing potential difference between the electrodes associated with a non-selected cell, said fourth pulsing potential difference being less than the firing voltage of said cell, wherein the duty factor of said second pulse train is selected to be less than ½ during said hold mode operation.

2. The apparatus of claim 1, wherein a pulse width of said second pulse train is selected to be 70 nsec to 160 nsec.

3. The apparatus of claim 1, wherein said second period is longer than said first period.

4. A plasma display apparatus comprising a first electrode group and a second electrode group disposed in an opposed relation relative to each other, the space intermediary of the opposed electrode groups being filled with a discharge gas to form cells therebetween, the plasma display comprising:

first means for applying a first pulse train of first voltage to said first electrode group for a first period at a predetermined interval in time division mode;

second means for applying a second pulse train of said first voltage to said first electrode group for a second period following successively said first pulse train, a frequency of said second pulse train being higher than said that of said first pulse train, and a duty factor of said second pulse train being of a value smaller than that of said first pulse train, where the duty factor is a ratio of a pulse width to a pulse period;

third means for applying a third pulse train of second voltage to at least one selected electrode in said second electrode group for said first period, said third pulse train being applied in synchronism and in combination with said first pulse train so as to produce a first pulsing potential difference between the electrodes associated with a selected cell, a phase of said third pulse train being opposite to a phase of said third pulse train such that said first pulsing potential difference is larger than a firing voltage of said cell to provide an address mode operation;

fourth means for applying to non-selected electrodes in said second electrode group and during said first period a fourth pulse train of third voltage pulses in synchronism with said first pulse train so as to produce a second pulsing potential difference between the electrodes associated with non-selected cells in combination with said first pulse train, a phase of said fourth pulse train being identical to the phase of said first pulse train such that said second pulsing potential difference is less than the firing voltage of said cell;

fifth means for applying a first direct-current voltage component in combination with said second pulse train to said at least one selected electrode in said second electrode group during said second period so as to produce a third pulsing potential difference between the electrodes associated with said selected cell, said third pulsing potential difference being smaller than the firing voltage of said cell, but also being large enough to continue the discharge of said selected cell due to a previously discharging state of said selected cell to provide a hold mode operation; and sixth means for applying a second direct-current voltage component in combination with said second pulse train to said non-selected electrodes in said second electrode group for said second period so as to produce a fourth pulsing potential difference between the electrodes associated with a non-selected cell, said fourth pulsing potential difference being less than the firing voltage of said cell, wherein the duty factor of said second pulse train is selected to be less than ½ during said hold mode operation;

said second pulse train is selected to be 70 nsec to 160 nsec, and said second period is longer than said first period.

* * * * *